United States Patent [19]

Nelson

[11] Patent Number: 4,932,692

[45] Date of Patent: Jun. 12, 1990

[54] LOCKING DEVICE FOR CLOSURES

[76] Inventor: Bascom M. Nelson, 309 Chaparral Trail, Beeville, Tex. 78102

[21] Appl. No.: 325,936

[22] Filed: Mar. 20, 1989

[51] Int. Cl.[5] ..... E05C 1/04

[52] U.S. Cl. ..... 292/148; 292/244; 292/162

[58] Field of Search ..... 292/148, 156, 162, 244, 292/157, 163, 175

[56] References Cited

U.S. PATENT DOCUMENTS

| | | | |
|---|---|---|---|
| 2,766,605 | 10/1956 | O'Brien | 70/8 |
| 3,334,933 | 8/1967 | Ehlers | 292/148 |
| 3,392,555 | 7/1968 | Beaver | 70/56 |
| 3,451,703 | 6/1969 | Roegner | 292/148 |
| 3,590,607 | 7/1971 | Beaver | 70/54 |
| 3,606,423 | 9/1971 | McCarthy | 292/148 |
| 4,290,281 | 9/1981 | Knaack et al. | 70/54 |
| 4,307,904 | 12/1981 | Daus | 292/148 |
| 4,613,175 | 9/1986 | Nelson | 292/148 |
| 4,742,701 | 5/1988 | Scavetto | 70/54 |

*Primary Examiner*—Richard E. Moore

*Attorney, Agent, or Firm*—G. Turner Moller

[57] ABSTRACT

A locking device comprises a support attached to a door and a striker attached to an adjacent door jamb. A bolt carried by the support includes coplanar ends received in slot members of the support. A central offset section of the bolt carries a padlock which is movable between locked and unlocked positions. In the locked padlock position, the padlock body abuts a shoulder of the support, preventing the bolt from moving. In the unlocked padlock position, the padlock body moves downwardly to clear the shoulder and allow belt movement. The locking device is symmetrical about a vertical axis and accordingly can be used without modification on left-swing and right-swing doors. The support and bolt are designed to be made from simple stamped metal pieces.

20 Claims, 2 Drawing Sheets

14
12
22
3
10
20
48
42
16
68
66
64
32
92
34
50
46
58
82
36
81
2
38
18

56
66
34
32
64
92
50
30
42
52
54
20
82
48
46
62
26
38
78
14
12
44
28
24
36
80
86
84

74
30
76
16
68
32
66
72
34
24
36
56
38
70

LOCKING DEVICE FOR CLOSURES

This invention relates to a locking device for closures, such as garage doors, metal or wooden doors or gates, windows or the like and more specifically to a locking device which incorporates a padlock for securing the device in a locked position.

The locking device of this invention is particularly suited for use in storage buildings, known as miniwarehouses. Many warehouses typically include a metal door which is mounted on a suitable frame for closing movement. A bolt type latch is often used to latch the door in its closed position.

One of the problems with padlock type locking devices is that they are manifestly subject to being cut by bolt cutters. Bolt cutters are widely available through commercial hardware stores and the like and consequently padlocks provide a deterrence to only the most amateur class of thieves. In response thereto, proposals have been made in the prior art to provide housing mechanisms which enclose the shackle of padlocks in order to protect the shackle of padlocks from bolt cutters. More accurately, the housings obstruct access to the padlock shackle so that bolt cutters cannot, get to them. Disclosures of this general type are found in exemplary U.S. pat. Nos. 2,766,605; 3,392,555; 3,334,933; 3,590,607, 3,606,423 4,290,281 and 4,742,701.

U.S. pat. No. 4,613,175 is a previous attempt by applicant to provide a padlock type locking device which protects the padlock from bolt cutters. Although this device operates quite successfully, it is labor intensive and expensive to make.

In the device of this invention, the bolt is mounted for movement in a housing or support which provides an overhanging lip covering a central part of the bolt. This support includes a generally planar back having openings therethrough for passing threaded fasteners to secure the support to a door. The support includes a top or upper wall from which depends a lip covering part of the bolt. The support also includes a pair of slot providing members on opposite ends thereof through which the bolt ends extend. The bolt ends are coplanar and are mounted in a path of movement toward and away from a striker on the door jamb. Between the coplanar ends is a central offset section providing a downwardly opening recess receiving a padlock having a shackle supported on a member carried by the bolt and a body which moves relative toward and away from the shackle during locking and unlocking movement of the padlock. The housing provides an abutment extending into the padlock recess for engaging the padlock body when the padlock is locked to prevent movement of the bolt relative to the support thereby maintaining the closure locked. When the padlock is unlocked and the padlock body moves downwardly in the recess away from the shackle, the padlock body moves out of the relative path of movement between the padlock body and the abutment. This allows the bolt to move out of the striker thereby allowing the door to open.

The bolt of this invention is made by deforming a metal strap of desired length, width and thickness into the preferred shape. The support is made by stamping or cutting a blank from a piece of stock and then deforming the support to provide the overhanging top and depending lip. The slot providing members of the support and the striker are made in essentially the same manner. Both comprise a stamped metal strap which is deformed into a generally C-shaped shape for receiving the bolt ends. The striker provides passages therethrough for the fasteners which attach the striker to the door jamb. The bolt is placed on the support, a slot providing member is placed on each bolt end and the members are welded to the support. The device of this invention is such that a minimum amount of labor is required to produce it.

It is an object of this invention to provide an improved locking device for closures in which a padlock is protected against a bolt cutter.

Another object of this invention is to provide an improved padlock protecting locking device in which a minimum of labor is required to make it.

A further object of this invention is to provide an improved padlock protecting locking device which is simple, sturdy and inexpensive.

Other objects and advantages of this invention will become more fully apparent as this description proceeds, reference being made to the accompanying drawings and appended claims.

IN THE DRAWINGS

Figure 1:
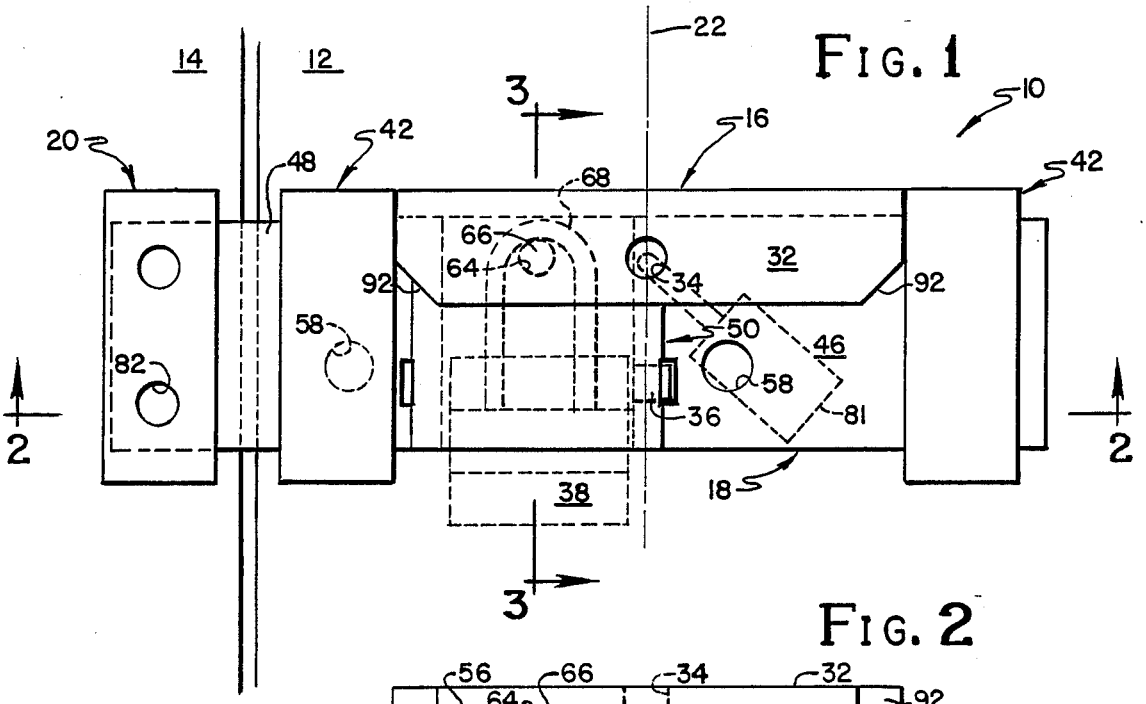
FIG. 1 is a front elevational view illustrating the device of this invention attached to a door and door jamb.

Referring to FIGS. 1—4, there is illustrated a locking device 10 illustrated as mounted on a movable door 12 adjacent a door jamb 14 and having, as major components, a support 16, a bolt 18 and a striker 20. As will be apparent more fully hereinafter, the door 12 may be a left-swing or a right-swing door because the locking device 10 is symmetrical about a vertical plane 22 and thus can be used with either left or right swing doors without modification.

The support 16 is deformed from a piece of flat metal stock and comprises a vertical planar back wall 24 having openings 26 therein for passing threaded fasteners 28 for securing the support 16 to the door 12. The back wall 24 merges with a horizontal top wall 30 from which depends a lip 32. The lip 32 provides a central opening 34 for purposes more fully apparent hereinafter. Extending from the back wall 24 is a lug 36 having square faces for abutting a padlock 38, for purposes more fully apparent hereinafter. The lug 36 may be a separate element attached to the back wall 24 or may be a section of the wall 24 which has been punched into the desired shape.

Welded to each vertical edge 40 of the back wall 24 is a slot providing member 42. As shown best in FIG. 4, the members 42 are generally C-shaped, having been deformed from a flat strip of metal, to provide an elongate slot 44 receiving the bolt 18.

The bolt 18 is deformed from an elongate metal strap of generally uniform width and thickness to provide coplanar ends 46, 48 and a central offset section 50 having walls 52, 54 generally perpendicular to the ends 46, 48 and a front wall 56 parallel to the ends 46, 48 and to the lip 32. The metal strap and consequently the ends 46, 48 are sized to be closely received by the slot members 42. A pair of openings 58 are provided in the ends 46, 48 of the bolt 18 to pass the fasteners 28 as will be more fully apparent hereinafter.

A window 60 is punched out of each corner between the ends 46, 48 and the walls 52, 54. The window 60 has a variety of functions. First, it provides a square face 62 for abutting the lug 36 and thereby limiting movement of the bolt 18 to a distance equal to the spacing between the faces 62. Second, the window 60 allows the lug 36 to be recessed, partially or wholly, within the confines of the walls 52, 54 at the limit of movement of the bolt 18 meaning that the offset section 50 can be narrower. Making the offset section 50 narrower is desirable because the padlock body is unable to twist inside the offset section 50 so the padlock shackle can enter the padlock body without any conscious attempt to align the body and shackle. Thus, the window 60 eliminates the need for means to restrain the padlock body from twisting.

A threaded opening 64 is provided in the front wall 56 to receive an Allen screw 66 for receiving a padlock shackle 68. To keep the shackle 68 aligned with the padlock body 70, an alignment mechanism 72 is provided. The mechanism 72 comprises first and second parallel walls 74, 76. As shown best in FIG. 3, the wall 76 preferably provides a threaded opening to pass the Allen screw 66 to captivate the bight of the shackle 68 to the bolt 18. The walls 74, 76 prevent the shackle 68 from rotating relative to the padlock body 70 so that the user merely has to push upwardly on the body 70 to cause the shackle 68 to enter and lock.

Figure 2:
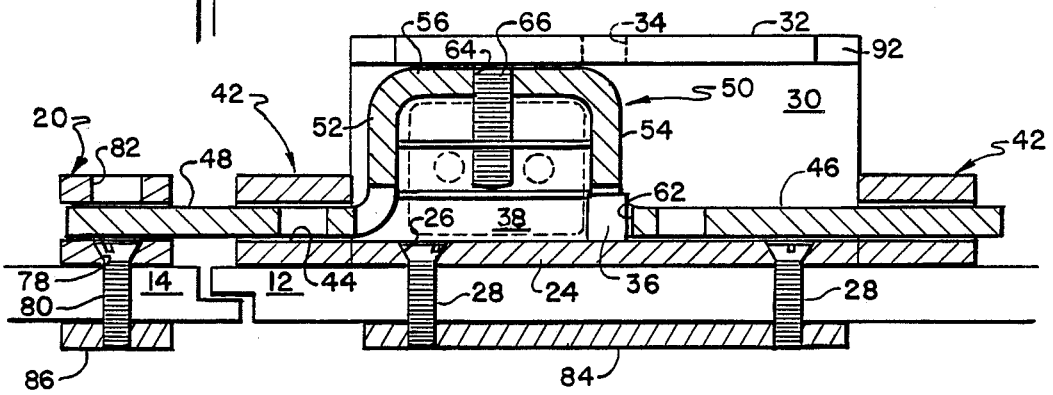
FIG. 2 is a horizontal cross-sectional view of the device of FIG. 1, taken substantially along line 2—2 thereof as viewed in the direction indicated by the arrows.
Figure 3:
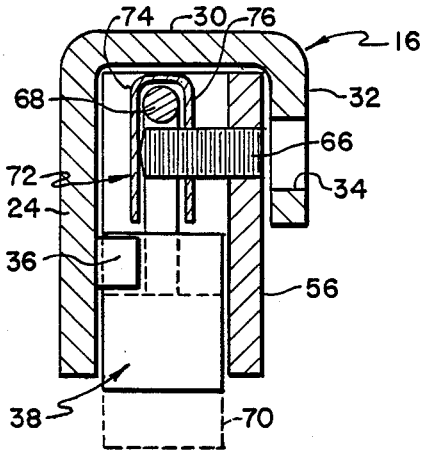
FIG. 3 is an enlarged vertical cross-sectional view of the device of FIG. 1, taken substantially along line 3—3 thereof as viewed in the direction indicated by the arrows.
Figure 4:
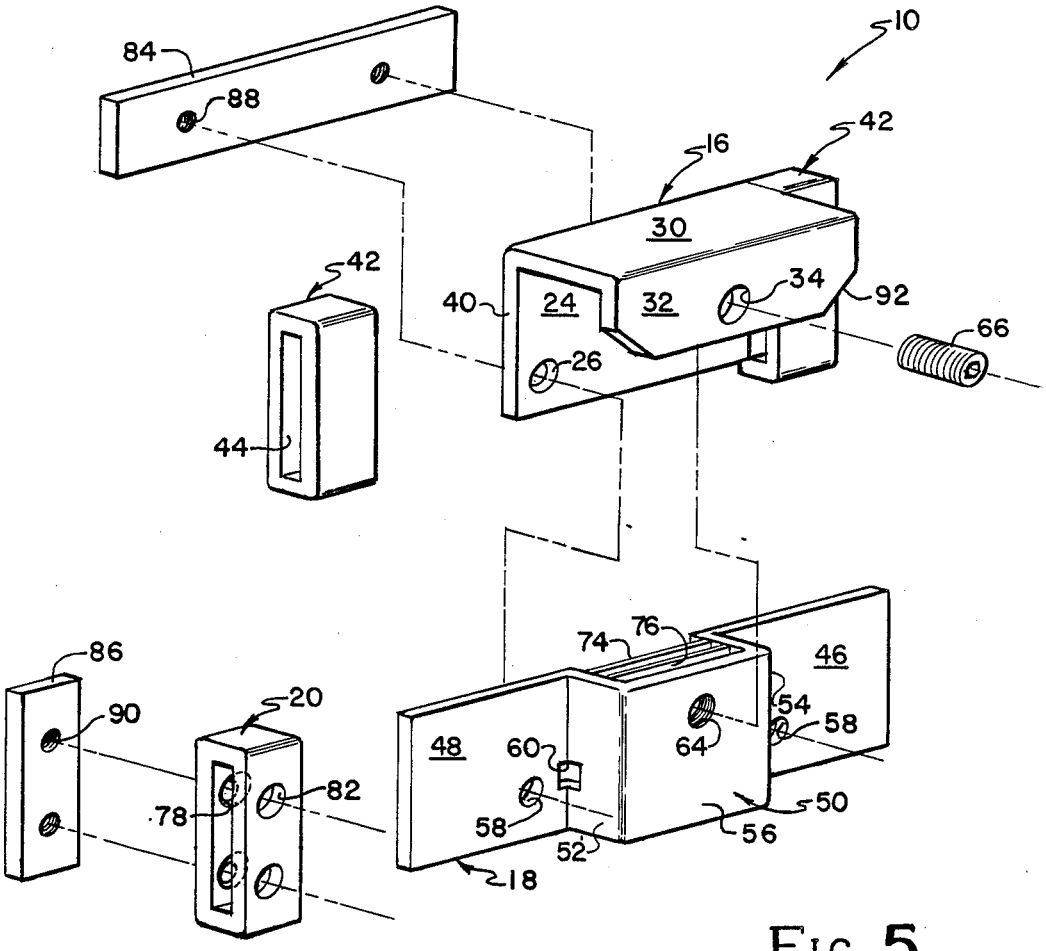
FIG. 4 is an exploded isometric view of the device of FIGS. 1–3.
Figure 5:
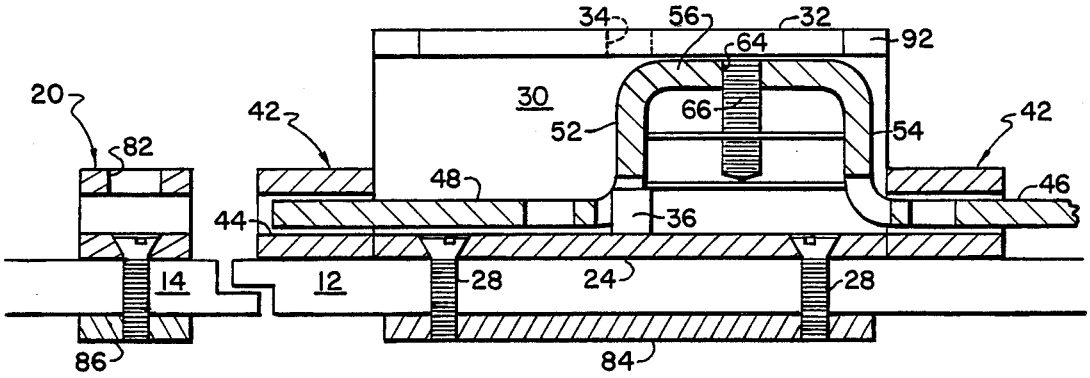
FIG. 5 is a horizontal cross sectional view, similar to FIG. 2, showing the bolt in an open or unlocked position.

As shown in FIG. 3, the lug 36 is above the padlock body 70 in the unlocked position thereby allowing the bolt 18 to move between its limit positions established by the faces 62. The padlock 38 cannot be locked until the bolt 18 is moved to a location where the lug 36 is alongside the padlock body 70 as shown in FIG. 2. This position corresponds to an extended position of the bolt 18 either to the left into the striker 20 or to a corresponding extended position to the right. When the bolt 18 is extended to either of its extreme positions, the padlock body 68 is pushed upwardly, the shackle 68 enters the padlock body 70 and locks the device 10 in one of its extreme positions.

The striker 20 is very similar to the slot providing members 42 and comprises a generally C-shaped structure deformed from a metal strip. The striker 20 provides a first set of openings 78 for passing threaded fasteners 80 to secure the striker 20 to the door jamb 14 and a second set of aligned openings 82 to allow a screw driver to reach the fasteners 80.

One of the applications of the locking device 10 is for miniwarehouses and similar situations where the enclosure is sealed by the door 12. In such situations, the fasteners 28, 80 may be wood screws, metal screws or bolts which extend into the enclosure. In this environment, it is desirable for the miniwarehouse owner to have the power to lock out the tenant if the tenant fails to pay monthly fees. This capability is easily provided by the locking device 10 of this invention by passing the shackle of a second padlock 81 through the opening 34 and thus blocking movement of the bolt 18 away from its closed position. As shown best in FIG. 2, sufficient room just exists for the shackle of a second padlock. It will be apparent, of course, that an additional opening could be provided in the lip 32 on each side of the opening 34 for this purpose.

Another application of the locking device 10 is for fence gates in which any nut attached to the fasteners 28, 80 would be accessible because the gate does not seal the enclosure. To avoid someone merely using a wrench to remove a nut from the back of the fasteners 28, 80, a pair of attachment plates 84, 86 are provided. The attachment plates 84, 86 provide a pair of spaced threaded openings 88, 90 corresponding to the spacing between the fasteners 28 and the fasteners 80. In the assembled position of the device 10, the plates 84, 86 cannot be rotated which means that the locking device 10 cannot be removed from a gate even though the back of the locking device 10 is accessible.

Manufacture and assembly of the locking device 10 should now be apparent. The support 16, the bolt 18 and the slot providing members 42 are deformed from metal stock. The members 42 are slid over the ends 46, 48 of the bolt 18 and welded to the edges 40 of the support 16 thereby captivating the bolt 18 to the support 16 and allowing bolt movement within the range allowed by the lug 36 and faces 60. To attach the locking device 10 to the door 12, the bolt 18 is moved to a central position where the openings 58 align with the openings 26. The truncated edges 92 of the lip 32 allow a screwdriver to reach the fasteners 28 to insert them into the door 12. At the position where the openings 58 align with the openings 26, the openings 34, 64 also align. The padlock 38 is placed in the offset section 50 and the Allen screw 66 is advanced into threading engagement with the opening 66 and into the threaded opening in the plate 76 until the screw 66 clears the lip 32. The striker 20 is installed in a conventional manner and the locking device 10 is ready to use.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A locking device for securing a closure in a locked condition relative to a jamb having a striker thereon using a padlock having a body and a shackle moveable into and out of locking engagement with the body, comprising a bolt having a padlock recess therein and means for supporting the padlock in the recess; and a support for the bolt including means for attaching the support to the closure;

means guiding the bolt in a path for movement toward and away from the striker; and an abutment for engaging the padlock body in a locked position of the padlock for preventing movement of the bolt relative to the support.

2. The locking device of claim 1 wherein the bolt provides a plane of symmetry perpendicular to the path of movement through the padlock recess dividing the bolt into mirror image halves.

3. The locking device of claim 1 wherein the bolt comprises first and second ends defining a plane and a central section offset from the plane, the central section comprising the padlock recess.

4. The locking device of claim 3 wherein the central section comprises a pair of walls generally perpendicular to the first and second ends, at least one of the walls providing a window for receiving the abutment therein at a limit of movement of the bolt relative to the support.

5. The locking device of claim 3 wherein the bolt comprises an elongate metal strap having a length substantially greater than a width and a width substantially greater than a thickness, the width and thickness being substantially uniform throughout the length.

6. The locking device of claim 5 wherein the guiding means comprises a deformed generally C-shaped metal strap having parallel front and rear walls defining therebetween a bolt receiving slot, the strap being welded to the support and the slot receiving the bolt therein.

7. The locking device of claim 3 further comprising means in the padlock recess for maintaining the shackle aligned with the padlock body.

8. The locking device of claim 7 wherein the shackle aligning means comprises first and second plates in the padlock recess for receiving the shackle therebetween.

9. The locking device of claim 1 wherein the support comprises a downwardly facing U-shaped section receiving the central section of the bolt therein.

10. The locking device of claim 9 wherein the U-shaped section provides an opening thereinto and further comprising a fastener carried by the bolt for supporting the shackle thereon, the fastener being obscured by the U-shaped section unless the fastener and the opening are aligned, the fastener and the opening being aligned only in an unlocked position of the padlock.

11. The locking device of claim 9 wherein the bolt comprises first and second ends defining a plane and the support comprises a planar back wall abutting the bolt ends, the bolt and support back wall having passages therethrough aligned only in an unlocked position of the bolt.

12. The locking device of claim 1 wherein the means attaching the support to a closure comprises a pair of threaded fasteners extending through the support and a plate having a pair of threaded openings therein, the threaded fasteners being threaded into the threaded openings.

13. The locking device of claim 12 further comprising means for preventing movement of the bolt away from a locked position thereof comprising a second padlock blocking movement of the bolt.

14. The locking device of claim 13 wherein the support comprises a U-shaped section receiving the central section of the bolt therein and having a first opening thereinto, the second padlock extending through the first opening, the preventing means comprising the first opening.

15. The locking device of claim 14 further comprising a fastener carried by the bolt for supporting the shackle thereon, the fastener being obscured by the U-shaped section unless the fastener and the first opening are aligned, the fastener and the first opening being aligned only in an unlocked position of the padlock.

16. A locking device for securing a closure in a locked condition relative to a jamb having a striker thereon using a padlock having a body and a shackle moveable into and out of locking engagement with the body, comprising a bolt having a padlock recess therein and means for supporting the padlock in the recess; and a support for the bolt including means for attaching the support to the closure;

means guiding the bolt in a path for movement toward and away from the striker; and means for selectively blocking movement of the bolt in response to the padlock shackle being in locking engagement with the padlock body and for selectively unblocking movement of the bolt in response to the padlock shackle being out of locking engagement with the padlock body.

17. The locking device of claim 16 wherein the bolt provides a plane of symmetry perpendicular to the path of movement through the padlock recess dividing the bolt into mirror image halves.

18. The locking device of claim 17 wherein the bolt comprises first and second ends defining a plane and a central section offset from the plane comprising the padlock recess and a pair of walls transverse to the first and second ends, at least one of the walls providing a window for receiving the abutment therein at a limit of movement of the bolt relative to the support.

19. A locking device for securing a closure in a locked condition relative to a jamb having a striker thereon, comprising a padlock having a body and a shackle movable into and out of locking engagement with the body;

a bolt having means supporting the padlock for movement with the bolt; and a support for the bolt including means for attaching the support to the closure;

means guiding the bolt in a path for movement toward and away from the striker; and an abutment for engaging the padlock body in a locked position of the padlock for preventing movement of the bolt relative to the support.

20. The locking device of claim 19 wherein the padlock body is movable from a first locked position for engaging the abutment and preventing movement of the bolt relative to the support to a second unlocked position spaced from the abutment for enabling movement of the bolt relative to the support.

* * * * *